US005778566A

United States Patent [19]

Edauw et al.

[11] Patent Number: 5,778,566

[45] Date of Patent: Jul. 14, 1998

[54] SPORTS SHOE

[75] Inventors: Peter Philip Edauw, Camalo' Di Povegliano; Mario Di Filippo, Casella D'Asolo, both of Italy

[73] Assignee: Stylus S.p.A., Castelfranco Veneto, Italy

[21] Appl. No.: 849,017

[22] PCT Filed: Sep. 16, 1996

[86] PCT No.: PCT/EP96/04052

§ 371 Date: May 23, 1997

§ 102(e) Date: May 23, 1997

[87] PCT Pub. No.: WO97/11618

PCT Pub. Date: Apr. 3, 1997

[30] Foreign Application Priority Data

Sep. 26, 1995 [IT] Italy ..... TV95A0112

[51] Int. Cl.[6] ..... A43B 23/07; A43B 11/00

[52] U.S. Cl. ..... 36/117.1; 36/10; 36/55; 36/117.6

[58] Field of Search ..... 36/10, 55, 88, 36/117.6, 117.1

[56] References Cited

U.S. PATENT DOCUMENTS

| | | | |
|---|---|---|---|
| 3,410,006 | 11/1968 | Raihund . | |
| 4,182,056 | 1/1980 | Dalebout | 36/71 |
| 4,706,316 | 11/1987 | Tanzi | 36/55 |
| 5,566,475 | 10/1996 | Donnadieu | 36/55 |
| 5,575,015 | 11/1996 | Paris et al. | 36/10 |

FOREIGN PATENT DOCUMENTS

| | | |
|---|---|---|
| A-0015862 | 9/1980 | European Pat. Off. . |
| A-0123636 | 10/1984 | European Pat. Off. . |
| A-1817970 | 4/1976 | Germany . |

*Primary Examiner*—M. D. Patterson

*Attorney, Agent, or Firm*—Rockey, Milnamow & Katz, Ltd.

[57] ABSTRACT

A sports shoe comprising a soft innerboot (2) having a cuff (5) that partially wraps around the user's leg. A semirigid collar (6) is associated with the cuff (5) and is laterally provided with first guiding seats (8*a*, 8*b*) for tabs (19*a*, 19*b*) that protrude from a semirigid body (15) associated with the innerboot (2) at least in the heel region (4), the collar (6) being connected to the body at the rear. The sports shoe allows to obtain a comfortable fit and correct movement of the user's foot during sports practice.

9 Claims, 4 Drawing Sheets

SPORTS SHOE

TECHNICAL FIELD

The present invention relates to a sports shoe preferably usable for sports such as roller skating, in-line skating, ice skating, hockey, mountain skiing, cross-country skiing, snowboarding, basketball, or gymnastics.

BACKGROUND ART

Current conventional sports shoes, such as for example skates, are constituted by a rigid shell that is adapted to contain a soft innerboot for the user's foot; an equally rigid quarter is articulated to said shell by means of studs, rivets, or other fastening systems located at the malleolar region.

These conventional sports shoes therefore have two rigid components that are articulated to each other to allow the leg to flex with respect to the foot; the rigidity of the shell and of the quarter allows to transmit forces.

These conventional sports shoes, however, have drawbacks in contrast with the above-mentioned advantages.

In skiing, the knee has a very active role in transmitting forces, whereas the ankle remains very static inside the relatively rigid structure constituted by the shell and by the quarter, which are nonetheless articulated in a point that is adjacent to the malleolar region.

In dynamic terms, this is correct; in terms of fit, however, it is not possible to achieve, for all users, optimum positioning of the seats for the malleoli due to the predefined articulation point constituted by the studs.

In skating, the ankle has a much more active role in generating forces; the consequent static condition of the ankle is a drawback, but said ankle must be protected against the torques that might be generated during sports practice by less expert skaters.

The current structure of the skate shoe is very similar to that of the ski boot, and excellently protects the ankle against torques but prevents the use of maximum lo efficiency in the movements that allow advanced practice of the sport.

Skaters who are experts in speed skating and roller and ice hockey conventionally wear, for this purpose, skates having a soft leather shoe that leaves the ankles free to act by controlled flexing.

DISCLOSURE OF THE INVENTION

A principal aim of the present invention is therefore to solve the described problems, eliminating the drawbacks of the cited prior art, by providing a sports shoe that allows the user to perform a correct movement of the foot while maintaining good support and protection for the foot and ankle.

Within the scope of this aim, an important object is to provide a shoe that allows to achieve a comfortable fit that can be adapted to the different foot shapes of the various users that lead to an individually different location of the malleoli.

Another important object is to provide a sports shoe having an optimum ratio between rigidity and flexing, both longitudinally and laterally, in order to achieve optimum performance even at the beginner's level.

Another object is to obtain, together with the above characteristics, a shoe the rigidity whereof is such as to allow optimum protection of the user's foot against any torques that can occur during sports practice.

Another object is to provide a shoe that is reliable and safe in use, can be obtained with low production costs, and can be produced with conventional machines and equipment.

This aim, these objects, and others that will become apparent hereinafter are achieved by a sports shoe, comprising a soft innerboot that has a cuff that partially wraps around the user's leg, characterized in that a semirigid collar is associated with said cuff and is laterally provided with first guiding seats for tabs that protrude from a semirigid body associated with said innerboot at least in the heel region, said collar being connected to said body at the rear.

BRIEF DESCRIPTION OF THE DRAWINGS

Further characteristics and advantages of the invention will become apparent from the following detailed description of a particular embodiment thereof, illustrated only by way of non-limitative example in the accompanying drawings, wherein.

WAYS OF CARRYING OUT THE INVENTION

Figure 1:
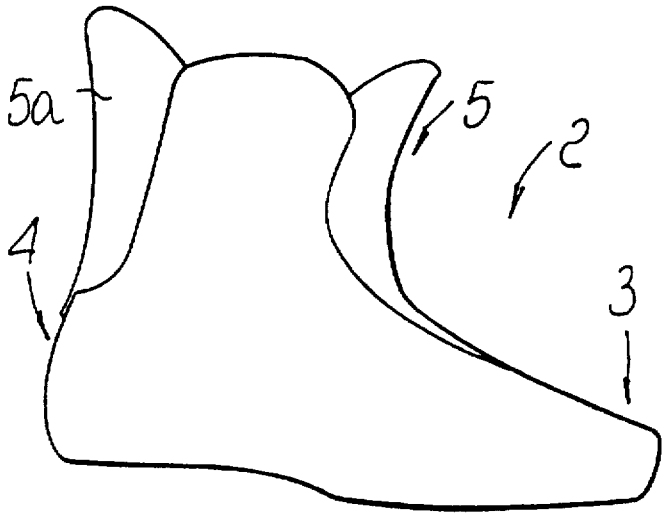
FIGS. 1 and 2 are, respectively, a side view and a rear view of a soft innerboot.
Figure 2:
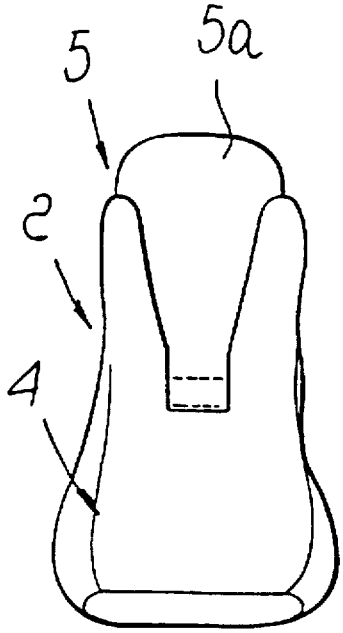
Figure 3:
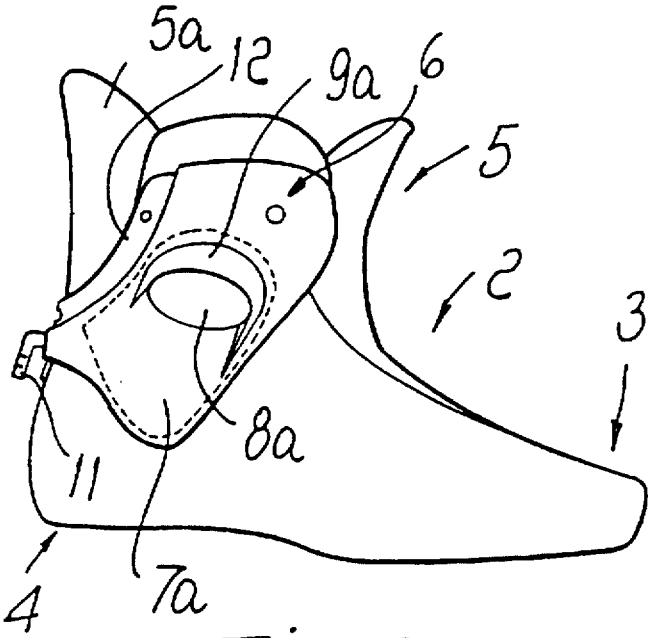
FIGS. 3 and 4 are, respectively, a side view and a rear view of the innerboot of the preceding figures with a collar associated therewith.
Figure 4:
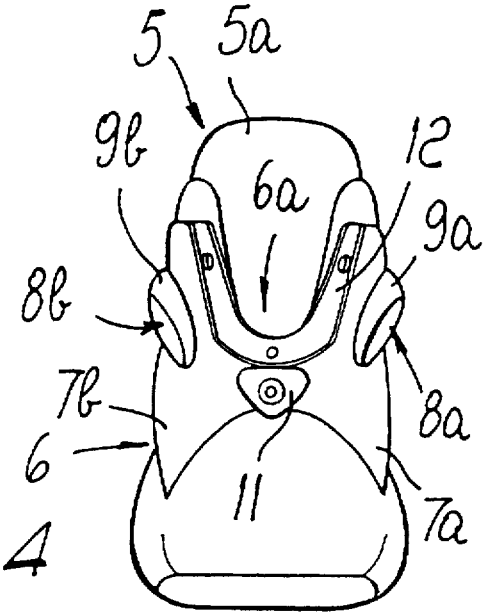
Figure 5:
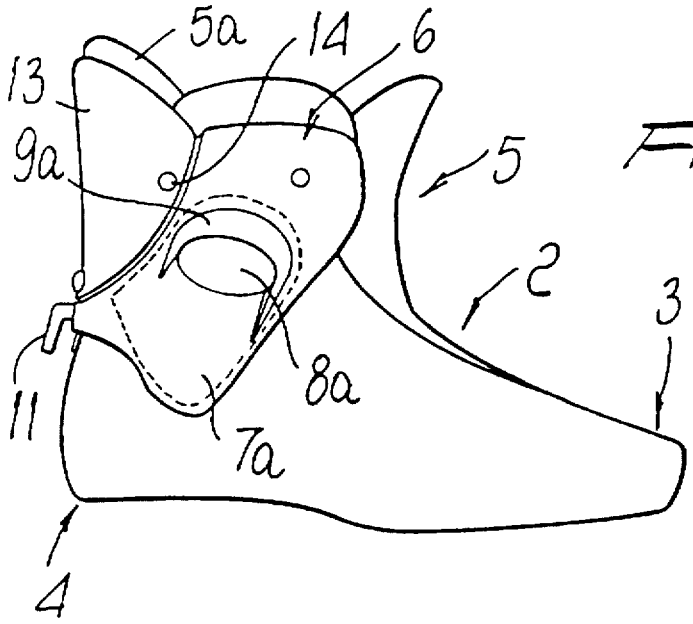
FIGS. 5 and 6 are, respectively, a side view and a rear view of the shoe of FIG. 5, with a reinforcement associated therewith.
Figure 6:
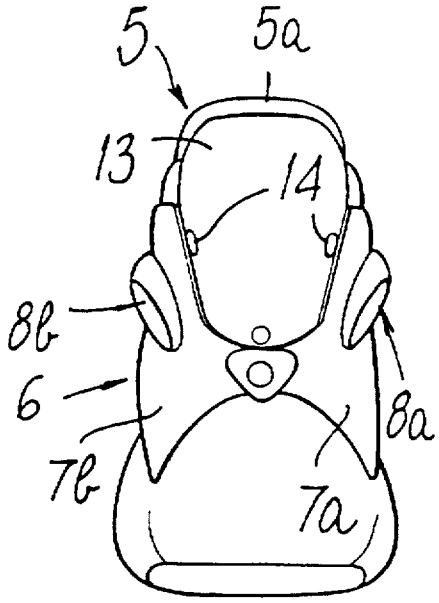
Figure 7:
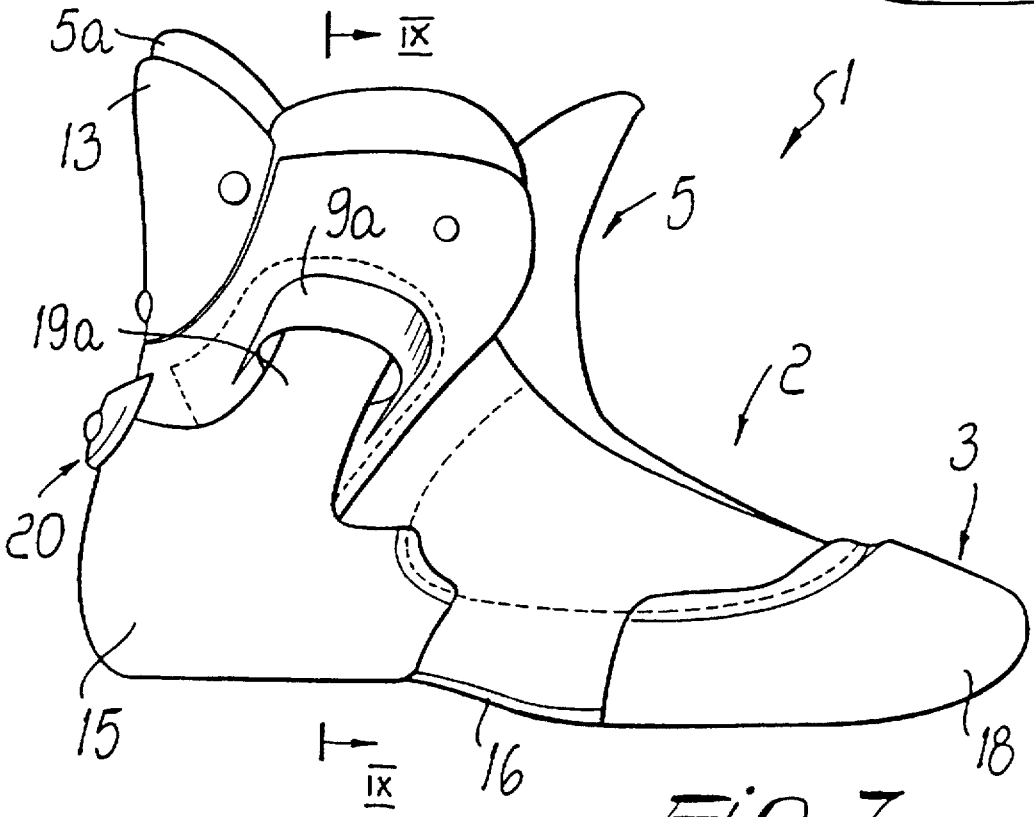
FIG. 7 is a side view of the invention.
Figure 8:
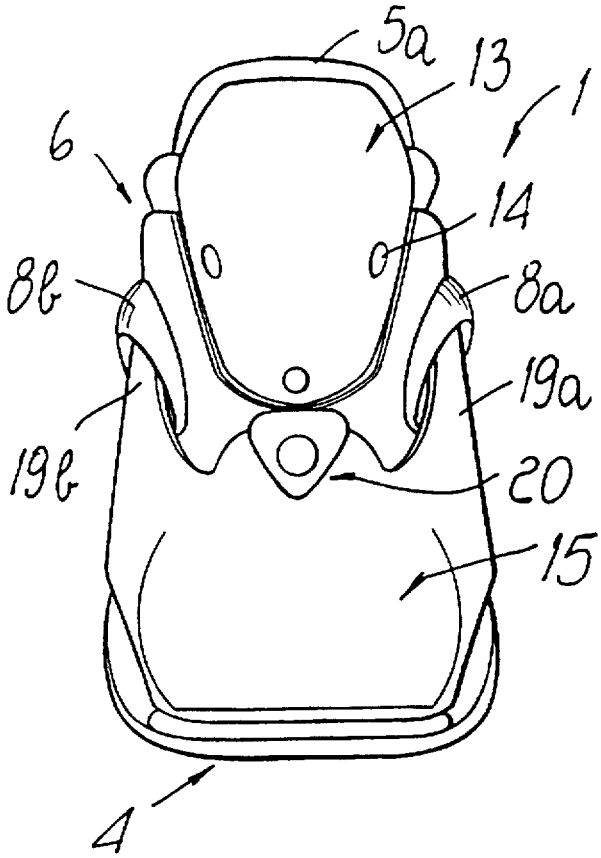
FIGS. 8 and 9 are, respectively, a rear view and a sectional view, taken along the plane IX—IX of FIG. 7, of the sports shoe.

With reference to the above figures, the reference numeral 1 designates a sports shoe, particularly for roller skating, in-line skating, ice skating, hockey, mountain skiing, cross-country skiing, snowboarding, basketball, or gymnastics.

The sports shoe 1 is constituted by an innerboot 2, preferably made of blanked or injection-molded soft material, possibly preformed by injection, which is stitched or welded so as to assume a desired shape.

In the innerboot 2, the reference numeral 3 designates a first tip region and the reference numeral 4 designates, at the opposite end, a second heel region.

Said innerboot 2 furthermore has a cuff 5 that partially wraps around the user's leg and in which a tongue **5*a* is formed to the rear; said tongue is provided by forming two longitudinal openings that partially affect the cuff 5** starting from its upper end.

A semirigid collar 6 is associable with the cuff 5 and partially wraps around said cuff 5 at the part lying above the second heel region 4, so as to affect the rear and lateral parts of the leg.

An essentially V-shaped central recess **6*a* is formed to the rear on the collar 6; its vertex is arranged approximately below the point where the tongue 5a couples to the cuff 5; a first protrusion 7*a* and a second protrusion 7*b* are provided adjacent to the recess 6*a* and protrude, in a tapering fashion, laterally to the innerboot 2 at the second heel region 4** so as to protect the malleoli.

A first circular opening and a second circular opening are provided respectively above the first protrusion **7*a* and the second protrusion 7*b* of the collar 6, and therefore above the malleoli, and are adapted to form first seats 8*a* and 8*b***.

A first band **9*a* and a second band 9*b* protrude from the upper perimetric edge of said first seats 8*a* and 8*b***.

Figure 9:
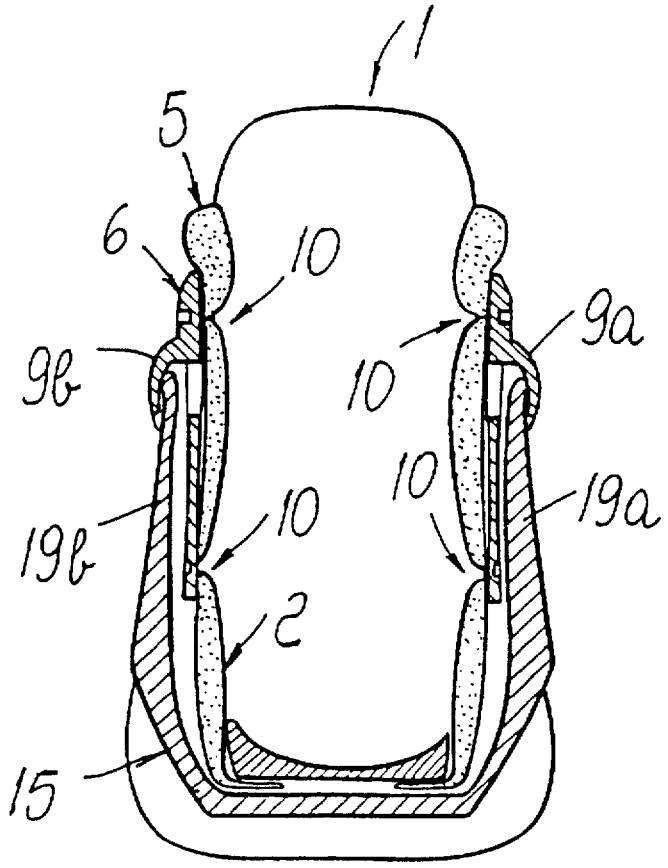
Figure 10:
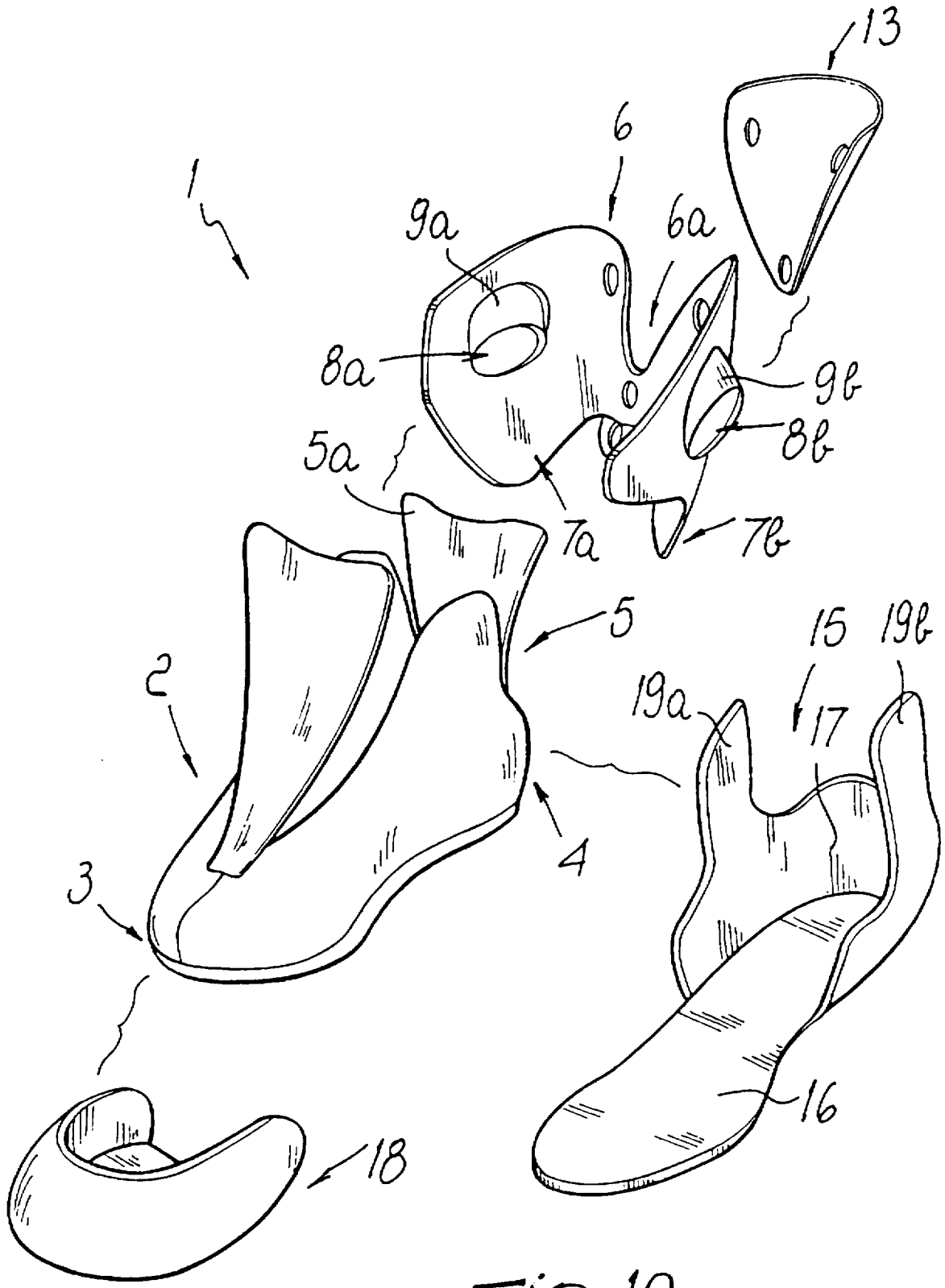
FIG. 10 is an exploded view of the shoe.

The collar 6 is preferably sewn laterally to the cuff 5, as shown in FIG. 9, where the seams are designated by the reference numeral 10.

The collar 6 is provided, at the rear, with an anchoring protrusion 11 the transverse cross-section whereof is preferably shaped like an inverted L, with the free end arranged at the sole of the sports shoe 2.

A thinner region is provided perimetrically to the recess 6*a* of the collar 6 and thus forms a depression 12.

A reinforcement 13 is associated with the collar 6 and is superimposed on the cuff 5 externally and to the rear, so that the lower perimetric edge is accommodated at the depression 12 and is connected thereto by conventional coupling means 14; said reinforcement 13 is thus superimposed on the tongue 5*a*.

A first semirigid body 15 is associated with the innerboot 2 and is constituted by a mid-sole 16 shaped complementarily to the lower part of said innerboot 2; a third band 17 protrudes perimetrically from the mid-sole 16 and wraps around the second region 4 of the innerboot 2 until it reaches approximately the pre-arch region.

A first tab 19*a* and a second tab 19*b* protrude from the third band 17 in the opposite direction with respect to the mid-sole 16 and are mirror-symmetrical with respect to a longitudinal median plane lying at right angles to said mid-sole 16.

The first tab 19*a* and the second tab 19*b* can be inserted, with their free end, at the first seats 8*a* and 8*b* that are present on the collar 6, which thus act as a guide for the free sliding of said first and second tabs 19*a* and 19*b*.

The third band 17 is provided, to the rear, with an engagement means 20 for the protrusion 11.

A second semirigid reinforcement and protection body 18 can be arranged at the first tip region 3 and is shaped complementarily to said first region 3.

The first body 15 and the second body 18 can of course be formed together monolithically.

Operation is as follows: the collar 6 is associated with the innerboot 2, thus placing the first seats 8*a* and 8*b* at the malleolar region; the rear reinforcement 13 is associated with the collar 6 by means of rivets or other devices; then the first body 15 is associated with the innerboot 2, inserting the upper end of the first and second tabs 19*a* and 19*b* in the first guiding seats 8*a* and 8*b* to position them between the collar 6 and the cuff 5; then the second body 18 is associated with the first tip region 3.

The lack of rivets or studs at the malleolar region and most of all the free connection between the tab and s the collar in that point allow the user's foot to move both longitudinally and laterally, in a controlled manner, with respect to the shoe.

It has thus been observed that the conceived shoe has achieved the intended aim and objects, since it allows the lo user to perform a correct movement of the foot while maintaining good support and protection for the foot and the ankle, since the collar is semirigid and fixed to the innerboot; this allows to achieve an excellent ratio between rigidity and flexing in order to achieve optimum performance even at the beginner level.

The shoe furthermore allows to achieve a comfortable fit that can be adapted to the shape differences of the user's feet, which become apparent in the position of the malleoli, since said region is not occupied by studs or rivets.

The invention is of course susceptible of numerous modifications and variations, all of which are within the scope of the same inventive concept.

The materials and the dimensions constituting the individual components of the device may of course be the most appropriate according to the specific requirements.

What we claim is:

1. Sports shoe, comprising a soft innerboot having a cuff that partially wraps around the user's leg, wherein a semirigid collar is associated with said cuff and is laterally provided with first guiding seats for tabs that protrude from a semirigid body associated with said innerboot at least in the heel region, said collar being connected to said body at the rear.

2. Shoe according to claim 1, comprising a tongue that is formed to the rear of said cuff by forming two longitudinal openings that partially affect said cuff starting from the upper end, wherein said semirigid collar partially wraps around said cuff at the upper part of the heel region so as to affect the rear and lateral parts of the leg, a central essentially V-shaped recess being formed to the rear on said collar, with the vertex arranged approximately below the point where said tongue couples to said cuff, a first protrusion and a second protrusion being adjacent to said recess and protruding, with a reduced thickness, laterally to said innerboot at said heel region so as to protect the malleoli.

3. Shoe according to claim 2, wherein first seats are provided on said collar, above said first and second protrusions, and are constituted by a first opening and a second opening which have a preferably circular shape and are formed above the malleoli.

4. Shoe according to claim 3, wherein said collar is provided with a first band and a second band that protrude from the upper perimetric edge of said first seats, said collar also having, to the rear, an anchoring protrusion that is preferably shaped like an inverted L in a transverse cross-section, the free end of said protrusion being arranged towards the sole of said sports shoe.

5. Shoe according to claim 4, wherein a thinner portion is provided perimetrically to said recess of said collar and is adapted to form a depression for the accommodation of the lower perimetric edge of a reinforcement that is connected to said collar by coupling means.

6. Shoe according to claim 4, wherein a first semirigid body is associated with said innerboot and is constituted by a mid-sole that is shaped complementarily to the sole of said innerboot, a third band protruding perimetrically from said mid-sole and wrapping around said heel region up to approximately the pre-arch region.

7. Shoe according to claim 6, wherein at least a first tab and a second tab protrude from said third band in the opposite direction with respect to said mid-sole, said tabs being mirror-symmetrical with respect to a median plane lying longitudinally to said innerboot, said at least one first and second tabs being slidingly insertable, at their free end, at said overlying first seats provided on said collar.

8. Shoe according to claim 7, wherein said third band is provided, at the rear, with a coupling means for said protrusion.

9. Shoe according to claim 8, wherein a complimentarily shaped second semirigid reinforcement and protection body can be arranged at the tip region of said innerboot, said first and second bodies being preferably connected to each other and formed monolithically so as to constitute said semirigid body.

* * * * *

UNITED STATES PATENT AND TRADEMARK OFFICE

CERTIFICATE OF CORRECTION

PATENT NO. : 5,778,566

DATED : July 14, 1998

INVENTOR(S) : Peter Phillip Edauw , et al.

It is certified that error appears in the above-indentified patent and that said Letters Patent is hereby corrected as shown below:

Column 1, line 38, please delete "maximum lo efficiency" and insert -- maximum efficiency --

Column 3, line 47, please delete "and s the" and insert -- and the --

Column 3, line 52, please delete "allows the lo" and insert -- allows the --

Signed and Sealed this

Sixth Day of March, 2001

Nicholas P. Godici

*Attest:*

NICHOLAS P. GODICI

*Attesting Officer*

*Acting Director of the United States Patent and Trademark Office*